United States Patent [19]

Dawson

[11] 4,395,284

[45] Jul. 26, 1983

[54] ABRASION RESISTANT MACHINABLE WHITE CAST IRON

[75] Inventor: Robert J. Dawson, Newmarket, Canada

[73] Assignee: Falconbridge Limited, Toronto, Canada

[21] Appl. No.: 340,053

[22] Filed: Jan. 18, 1982

[30] Foreign Application Priority Data

Feb. 20, 1981 [CA] Canada ..... 371420

[51] Int. Cl.[3] ..... C22C 38/56

[52] U.S. Cl. ..... 75/123 CB; 75/128 D; 148/35; 148/138; 148/141

[58] Field of Search ..... 75/123 CB, 126 A, 128 D; 148/35, 138, 141, 37, 3

[56] References Cited

U.S. PATENT DOCUMENTS 4,325,758 4/1982 Milligan ..... 148/3

FOREIGN PATENT DOCUMENTS 53-1122 1/1978 Japan ..... 148/35
53-113714 10/1978 Japan ..... 75/126 A
663748 5/1979 U.S.S.R. ..... 75/126 A
779428 11/1980 U.S.S.R. ..... 75/123 CB

*Primary Examiner*—Peter K. Skiff
*Attorney, Agent, or Firm*—Richard J. Hicks; Stanley E. Johnson

[57] ABSTRACT

A cast iron alloy composition comprising 2.5–3.5% carbon, 0.5–1.0% manganese, 0.25–1.5% silicon, 13–19% chromium, 0.8–3.0% nickel, balance essentially iron which is machinable in the annealed condition and abrasion resistant in the hardened condition. The alloy may be annealed by furnace cooling, at a rate between 100° C. and 350° C./hr., from the austenitizing temperature, and hardened by air cooling from the austenitizing temperature.

8 Claims, 4 Drawing Figures

ABRASION RESISTANT MACHINABLE WHITE CAST IRON

FIELD OF INVENTION

This invention relates to castable and machinable iron based alloys which can subsequently be hardened and rendered abrasion resistant.

BACKGROUND TO THE INVENTION

White cast irons, and in particular carbon-containing, nickel-chromium bearing iron based alloys such as Ni-Hard®, have long been known in the metallurgical industries for their hardness and ease of castability, and for their relative inexpensiveness. The physical properties of such white cast irons can, within certain limits, be modified by suitable adjustments in the relative ratios of the noted alloying elements. Some further improvements can also be made by additions of other alloying elements, such as for instance copper, molybdenum, tungsten, cobalt. Such additions, however, increase the cost of production of the iron based alloy, and while one or two aspects of its physical properties are extended, some others may be detrimentally affected.

Compositions for nickel and chromium-bearing chill cast irons with good abrasion and oxidation resistance, which can be cast in complex shapes, are described in U.S. Pat. Nos. 1,988,910; 1,988,911 and 1,988,912, and are characterized by the chromium content of these alloys being less than the nickel present. An alloy with similar properties, for thick castings of substantial size, with fine grain structure and good abrasion resistance, is taught in U.S. Pat. No. 2,662,011 with chromium contents less than 15% and having nickel contents between 4 and 8%. The wear and abrasion resistant properties of nickel and chromium bearing white cast irons are described in U.S. Pat. No. 3,410,682 and Canadian Pat. No. 848,900; these alloys contain in addition, manganese and molybdenum in well-defined concentration ranges.

The alloy of U.S. Pat. No. 3,414,442 is specified to have chromium levels below 15% and nickel concentrations between 4 and 8%; in addition this patent also teaches a heat treatment process of the alloy to increase its hardness after casting.

Wear resistant, nickel-bearing white cast irons are described in Russian Pat. No. 583,192 with chromium contents in excess of 20 percent and nickel contents falling between 1.2 and 3.2 percent. The alloy of the Russian patent also contains manganese between 0.4 and 0.6 percent and silicon between 0.6 and 1.0 percent.

The corrosion and erosion resistant white cast iron of U.S. Pat. No. 4,080,198 has a high chromium content, such as in excess of 28%, with molybdenum, nickel and copper additions of less than 2%. According to the heat treatment process taught therein, part of the carbon contained in the alloy as molybdenum and chromium carbides dispersed in the austenitic matrix, can be resolutionized to reduce the hardness of the alloy by a relatively small extent, and the alloy can subsequently be aged back to acquire the desired hardness.

U.S. Pat. Nos. 3,165,400 and 3,235,417 teach oxidation resistant austenitic casting alloy compositions with relatively low carbon contents, having chromium contents between 12 and 35% and nickel contents up to 15%. The alloys with the composition ranges of these two patents, contain several other alloying elements as well, and in addition the nickel, manganese and cobalt concentration levels are interrelated according to a pattern defined therein.

The abrasion resistant nickel, chromium-bearing iron based alloy described by prior art patents hereinabove can be cast in a desired shape. They are, however, not machinable by conventional methods, and any adjustment in size, shape, modification of surface or refinement in critical dimensions, can only be achieved by grinding. Grinding is, as is well known, a costly process, especially on larger pieces, and difficult to control.

OBJECT OF THE INVENTION

It is the object of this invention to provide an inexpensive white cast iron and a heat treatment thereof. It is a further object of this invention to provide a white cast iron which is annealable at a commercially achievable and acceptable cooling rate and which is machinable. It is another object of this invention to provide a white cast iron, annealed at a practicable cooling rate, which is subsequently rehardened by heat treatment. Unless otherwise indicated all alloy percentages in this specification are percentages by weight.

By one aspect of this invention there is provided a cast iron alloy consisting essentially of about 2.5 to 3.5% carbon, 0.5–1.0% manganese, 0.25–1.5% silicon, 13–19% chromium, 0.8–3.0% nickel, balance iron and incidental impurities, which is abrasion resistant in the hardened condition and machinable in the annealed condition.

By another aspect of this invention there is provided a method of heat treating a cast iron alloy consisting essentially of about:

2.5–3.5% carbon
0.5–1.0% manganese
0.25–1.5% silicon
13–19% chromium
0.8–3.0% nickel
balance iron and incidental impurities, comprising cooling said alloy at a rate between 100° C. and 350° C. per hour from a temperature above the austenitizing temperature so as to produce an annealed machinable alloy having a hardness of less than about 45 Rc.

By yet another aspect of this invention there is provided a method of heat treating a cast iron alloy consisting essentially of about:

2.5–3.5% carbon
0.5–1.0% manganese
0.25–1.5% silicon
13–19% chromium
0.8–3.0% nickel
balance iron and incidental impurities, comprising air cooling said alloy from a temperature above the austenitizing temperature so as to produce an abrasion resistant alloy having a hardness of at least 60 Rc.

DETAILED DESCRIPTION OF THE INVENTION

Figure 2:
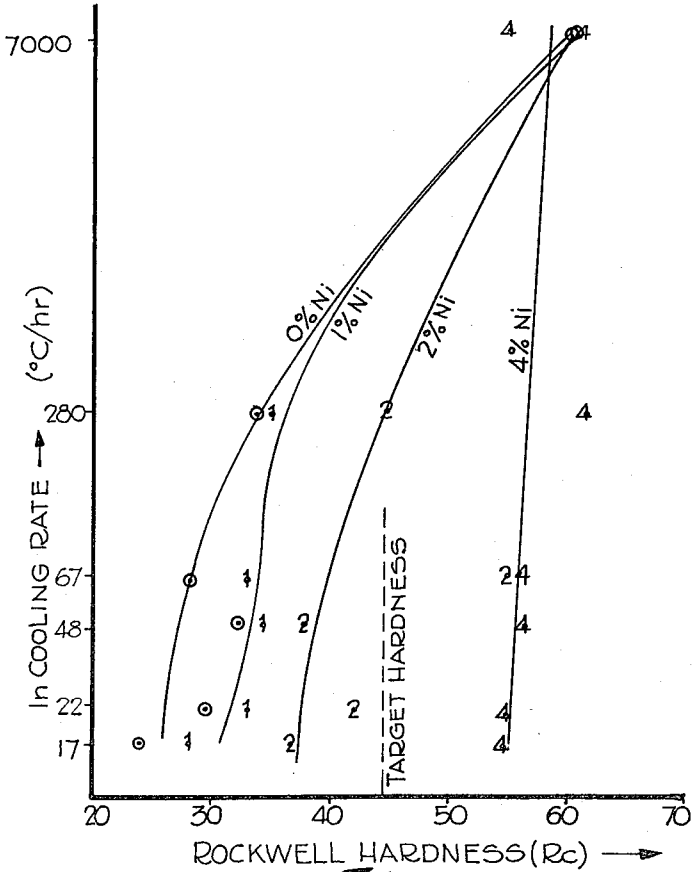
FIG. 2 is a graph illustrating the relationship between cooling rate, hardness and nickel content of white cast iron.

Castings for a very diverse range of applications are often made of inexpensive white cast irons, since these have reasonable strength and high wear and abrasion resistance. Nickel additions to the alloy increase its wear resistance. The castings often require further machining for more intricate shaping, adjustments in dimension and the like. While it is possible to grind the castings this is often expensive, very time consuming and has other limitations. The castings with alloy composition ranges of the present invention can be annealed to a ferritic, machinable state, machined to the required size, shape and dimensions, then heat treated to attain the desired hardness and abrasion resistance.

As applied to ferrous alloys, the term annealing is generally taken to mean cooling the alloy, from a temperature which is sufficiently high, generally of the order of 725° C.-900° C., and at which it has been held for a sufficient time to promote transformation of the structure to a carbon rich gamma phase known as austenite, at a rate which is sufficiently slow, generally of the order of 17° C./hr or less for plain iron-carbon alloys, to permit a diffusional transformation of the gamma phase to a soft alpha (ferrite) phase and a precipitated iron carbide (cementite) phase. The size of the hard, precipitated, cementite particles is dependent on the cooling rate and other variables including alloying additions. Higher rates of cooling suppress the austenite to ferrite and cementite transformation wholly or in part and the carbon in the austenite is retained in a state of metastable solution in the form of extremely hard and brittle martensite. Cooling or annealing rates of the order of 17° C./hr are considered economically and industrially unfeasible as they are so slow that they tie up expensive equipment for too long and heretofore it has been difficult to produce a martensitic white cast iron which has been annealed sufficiently to produce a structure which is soft enough to machine. Cooling rates of the order of 150°-400° C./hr are considered economically and industrially feasible as they do not tie equipment up for too long. It has been found, surprisingly, that a white cast iron consisting essentially of carbon of 2.5 to 3.5 weight percent, chromium 13 to 19 percent, silicon 0.25 to 1.5 percent and manganese 0.5 to 1.0%, balance iron can be annealed at an industrially practicable cooling rate, such as 280° C./hr, if nickel is added in the range of about 0.8 to 3 percent. Preferred alloys within the aforesaid range consist essentially of carbon 2.8-3.25%, manganese 0.65-0.80%, silicon 0.4-0.75%, chromium 15.2-15.7%, nickel 1.0-2.5%, balance iron and incidental impurities. After cooling or annealing from an austenitizing temperature of the order of 955° C. at a rate of about 280° C./hr the casting alloy composition described hereinabove, has a Rockwell C hardness value less than 45, and can be machined by conventional methods.

Figure 1:
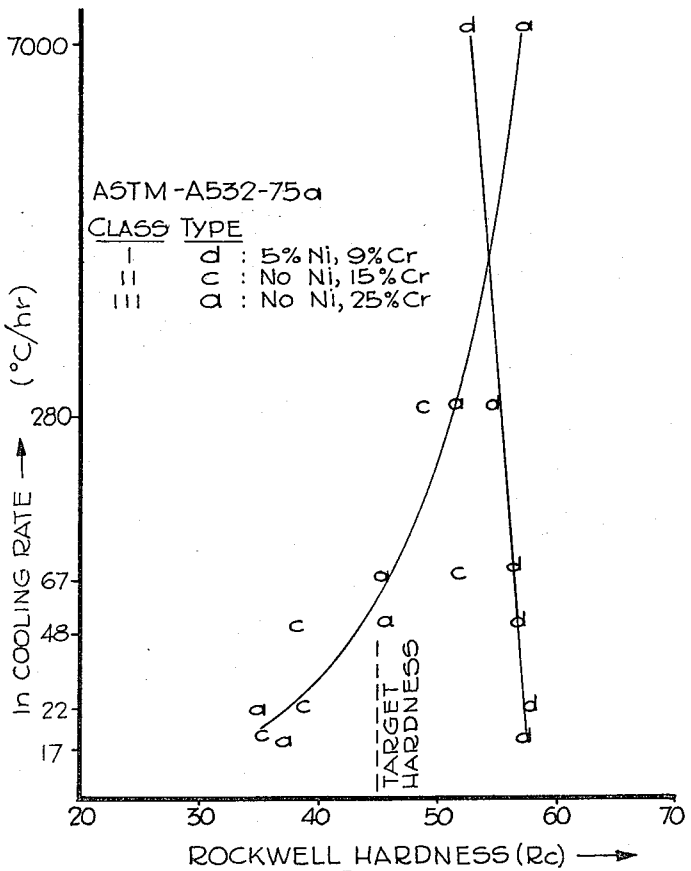
FIG. 1 is a graph illustrating the relationship between cooling rate and hardness for various nickel-chrome white cast irons.

FIG. 1 illustrates the relationship between Rockwell hardness attained and cooling rate, comparing three classes of alloys, as defined by ASTM. The indicated "target hardness" is the upper limit of that required for conventional machining. For the sake of simplicity only the nickel and chromium contents of these cast irons are shown. FIG. 2 shows the effect nickel additions were found to bear on the annealability of an iron base alloy with the following base composition:

carbon—3%
chromium—16%
manganese—0.8%
silicon—0.4%
iron—balance.

Figure 3:
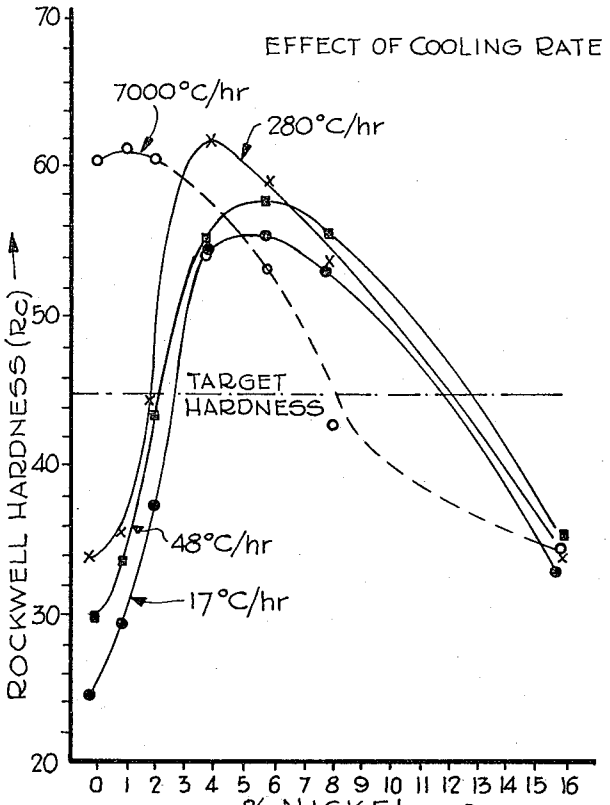
FIG. 3 is a graph illustrating the relationship between hardness, nickel content at different cooling rates.

It can be clearly seen from FIG. 2 that the target hardness of 45 Rockwell hardness (Rc) can be attained by cooling from an austenitizing temperature above 955° C., at a practicable and easily achievable cooling rate around 280° C./hr in still air, an alloy having the above base composition and a nickel content between 1 and 2.5%. An iron based alloy of the above base composition and with 4% nickel content, on the other hand, cannot be softened to the required hardness by annealing, while the same alloy with no or very low nickel additions can be annealed and machined readily but, as seen from FIG. 3 cannot be rehardened unless a drastic hardening and quenching treatment is applied to achieve a cooling rate of the order of 7000°/hr with its attendent problems of cracking and the like. FIG. 3 represents another relationship between Rockwell C hardness and the nickel content of the white cast iron, attained at different cooling rates. It is again clearly shown that the target hardness of 45 Rc can be attained at 280° C./hr cooling rate, with the casting alloy composition having nickel contents between 1 and 2%.

Figure 4:
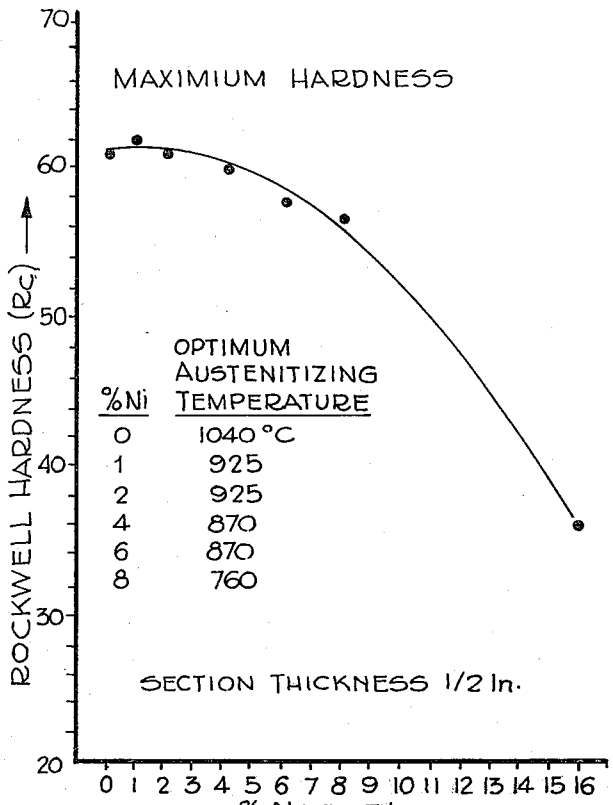
FIG. 4 is a graph illustrating Rockwell C hardness which can be attained by white cast irons with a range of nickel contents, by heat treatment at various temperatures and subsequent to annealing.

It is necessary that the castings be hardenable to achieve the required abrasion resistance, after machining to the required size, shape and dimensions has been accomplished. As mentioned above, nickel is added to iron based casting alloys to enhance their abrasion and wear resistance. These properties are required in many casting applications such as for example pump components, valves, etc. A minimum Rockwell C hardness of 60 is desirable in such applications. FIG. 4 shows the hardness in Rc values acquired by nickel-bearing alloys of the base composition described hereinabove, when rapidly air cooled from temperatures above their respective austenitizing temperatures. It is clearly indicated by the diagram that as the nickel content of the casting alloy increases, the austenitizing temperature and the final hardness of the casting both decrease. It will be obvious to those familiar with this art, that alloys with nickel contents higher than four percent are unsuitable for abrasion and wear resistant castings. At the other end of the scale, an iron based alloy with no, or very little, nickel content and in relatively thin sections will be hardenable to the required hardness value only when heated to a relatively high austenitizing temperature and subjected to a drastic quench such as water quenching. The iron based alloy cast in thick sections, with compositions taught in this invention and having nickel additions between 1 and 2 percent, on the other hand, can be hardened after annealing and machining, to Rc values in excess of 60 by heating to austenitizing temperatures between 925°-960° C. followed by air cooling.

The advantages of the casting alloy composition ranges taught in this invention can be illustrated by the following examples.

EXAMPLE 1

Iron based casting alloys of various chromium and nickel contents were subjected to milling after annealing, and their respective machinability compared in Table I together with data pertaining to their machining conditions. The principal alloying additives are indicated under the heading "material" with the Rockwell hardness of the material (Rc) in brackets. The relatively light wear on the cutting tool, indicating good machinability, is shown by the white cast iron of this invention containing 15% chromium and 1.5 percent nickel, by two sets of millings to different depths.

TABLE I

COMPARISON OF MILLING DATA FOR ABRASION RESISTANT ALLOYS

| Material | RPM | Feed (inch/min) | Cut (inches) | No. of Passes before Tips Replaced |
|---|---|---|---|---|
| F28-O* (Rc 35) | 112 | 1 29/64 | 0.050 | 7 |
| 15Cr 3 Mo (Rc 37) | 112 | 1 29/64 | 0.050 | 3 |
| 15Cr 8Ni (Rc 36) | 112 | 1 29/64 | 0.050 | 1 |
| (Austenitic) | 56 | 3/8 | 0.050 | 1 |
| 15Cr—1½Ni) (Rc 36) | 112 | 1 29/64 | 0.050 | 6 |
| (Ferritic) | 112 | 61/64 | 0.100 | 6 |

*No nickel present, chromium nominally at 28%.

EXAMPLE 2

Casting alloys with various nickel contents and in thick sections, were first annealed by heating to austenitizing temperatures and furnace cooling at a rate of about 280° C./hr to render them machinable, then hardened. The hardening heat treatment and the attained hardness, as averaged values, and as individual values measured at a distance from the surface, are shown for each alloy in Table II. The compositions of the casting alloys of Table II are shown in Table III. It is clear from this example that thick alloy castings with chromium content around 16% and nickel content of 2% will harden to an average value of 64 Rc and at substantial depths, when heated to a temperature higher than 925° C. and then cooled in still air. Thus this alloy composition range is machinable after casting and annealing at an acceptable cooling rate, and can be subsequently hardened to high wear and abrasion resistance.

TABLE II

ROCKWELL HARDNESS (HRc) DATA FROM HARDENABILITY TESTS

| Material | Heat Treatment | Average Hardness (HRc) | Distance from Surface (cm) 0.1 | 0.6 | 1.3 | 1.9 | 2.5 | 3.2 | 3.8 |
|---|---|---|---|---|---|---|---|---|---|
| A 457 | 1040° C./ | 62av | 61 | 62 | 62 | 62 | 62 | 62 | 62 |
| F 28-0 | AC | | 62 | 61 | 62 | 62 | 62 | 63 | 62 |
| AM 1407 | 1040° C./ | 47av | 47 | 47 | 46 | 46 | 46 | 46 | 47 |
| 16Cr—ONi | AC | | 49 | 49 | 49 | 47 | 48 | 47 | 47 |
| AM 1408 | 925° C./ | 64av | 65 | 65 | 64 | 65 | 64 | 66 | 65 |
| 16Cr—2Ni | AC | | 63 | 62 | 62 | 63 | 64 | 64 | 60 |
| | | | 62 | 64 | 64 | 65 | 65 | 65 | 65 |
| AM 1409 | 760° C./ | 49av | 49 | 49 | 50 | 49 | 50 | 50 | 50 |
| 16Cr—8Ni | AC | | 48 | 48 | 48 | 49 | 49 | 49 | 47 |

TABLE III

CHEMICAL ANALYSES OF ALLOYS TESTED

| Sample | % C | % Si | % Mn | % Cr | % Ni | % Mo |
|---|---|---|---|---|---|---|
| A 457 | 2.82 | 0.75 | 0.65 | 26.8 | 0.26 | — |
| AM 1407 | 3.16 | 0.42 | 0.79 | 15.2 | 0.10 | — |
| AM 1408 | 3.23 | 0.39 | 0.75 | 15.5 | 2.10 | — |
| AM 1409 | 3.16 | 0.39 | 0.75 | 15.6 | 8.16 | — |

EXAMPLE 3

A white cast iron with base composition of the present invention and with 1% nickel addition, was heat treated as described with reference to Example 2, and its hardness and abrasion resistance compared to various alloys, as classed by ASTM. The scratching abrasion tests were similar to that defined by ASTM Standard Practice G65-80. The alloys were also subjected to grinding abrasion tests according to the description by T. W. Boyes published in the Foundry Supplement, Iron and Steel, February 1969 issue, pp. 57-63. The hardness values and the average weight losses of the alloys in the abrasion tests are listed in Table IV.

TABLE IV

| Description of Alloy Tested | Rockwell Hardness | Scratching Abrasion Wt. Loss | Grinding Abrasion Wt. Loss |
|---|---|---|---|
| 16Cr—3C—1Ni Present Invention | Rc 64 | 0.23 g | 2.6 g |
| ASTM-A532-75a Class III, Type A | Rc 61 | 0.23 g | 3.2 g |
| ASTM-A532-75a Class I, Type D | Rc 60 | 0.20 g | 3.0 g |
| ASTM-A532-75a Class II, Type C | Rc 65 | 0.17 g | 1.8 g |

It can be seen that the hardened, cast alloy that falls within the composition range of this invention, compares very well with other abrasion resistant alloys, but it is, in addition, annealable at a commercially practicable cooling rate which renders it machinable as well, and subsequently hardenable in thick sections to a desirable hardness.

I claim:

1. A cast iron alloy consisting essentially of about 2.5-3.5% carbon, 0.5-1.0% manganese, 0.25-1.5% silicon, 13-19% chromium, 0.8-3.0% nickel, balance iron and incidental impurities; which is abrasion resistant in the hardened condition and machinable in the annealed condition.

2. A cast iron alloy as claimed in claim 1 consisting essentially of about 2.8-3.25% carbon, 0.65-0.80% manganese, 0.4-0.75% silicon, 15.2-15.7% chromium, 1.0-2.5% nickel, balance iron and incidental impurities.

3. An abrasion resistant white cast iron alloy as claimed in claim 1 or 2, heat treated to provide a hardness of at least 60 Rc.

4. A machinable cast iron alloy as claimed in claim 1 or 2 in an annealed condition and having a hardness of not more than 45 Rc.

5. A method of heat treating a cast iron alloy consisting essentially of about:

2.5-3.5% carbon
0.5-1.0% manganese
0.25-1.5% silicon
13-19% chromium
0.8-3.0% nickel
balance iron and incidental impurities, comprising cooling said alloy at a rate between 100° C. and 350° C. per hour from a temperature above the austenitizing temperature so as to produce an annealed machinable alloy having a hardness of less than about 45 Rc.

6. A method of heat treating a cast iron alloy consisting essentially of about:

2.5-3.5% carbon
0.5-1.0% manganese 0.25–1.5% silicon
13–19% chromium
0.8–3.0% nickel
balance iron and incidental impurities, comprising air cooling said alloy from a temperature above the austenitizing temperature so as to produce an abrasion resistant alloy having a hardness of at least 60 Rc.

7. A method of heat treating as claimed in claim 5 including heating said annealed alloy to a temperature above the austenitizing temperature and air cooling so as to produce an abrasion resistant alloy having a hardness of at least 60 Rc.

8. A method of heat treating as claimed in claim 5 or 7 including machining said alloy in said annealed condition.

* * * * *